United States Patent [19]

Ravier et al.

[11] 4,080,278

[45] Mar. 21, 1978

[54] CATHODE FOR ELECTROLYTIC CELL

[75] Inventors: Dominique Ravier, Paris; Jean Grosbois, L'Isle Adam, both of France

[73] Assignee: Rhone-Poulenc Industries, Paris, France

[21] Appl. No.: 702,847

[22] Filed: Jul. 6, 1976

[30] Foreign Application Priority Data

| | | |
|---|---|---|
| Jul. 8, 1975 | France | 75 21364 |
| May 4, 1976 | France | 76 13249 |

[51] Int. Cl.[2] ..... C25B 11/10; C25B 11/04

[52] U.S. Cl. ..... 204/242; 204/286; 204/290 R; 204/292; 204/293

[58] Field of Search ..... 204/290 R, 290 F, 292, 204/286, 128, 293, 242

[56] References Cited

U.S. PATENT DOCUMENTS

| | | | |
|---|---|---|---|
| 3,033,775 | 5/1962 | Chevigny et al. | 204/293 X |
| 3,291,714 | 12/1966 | Hall et al. | 204/293 X |
| 3,957,600 | 5/1976 | Ives et al. | 204/293 X |
| 3,977,958 | 8/1976 | Caldwell et al. | 204/290 R X |

FOREIGN PATENT DOCUMENTS

| | | | |
|---|---|---|---|
| 1,299,287 | 7/1969 | Germany | 204/128 |

*Primary Examiner*—John H. Mack
*Assistant Examiner*—D. R. Valentine

[57] ABSTRACT

A cathode for an electrolytic cell, providing a low overvoltage on contact with the electrolyte, having at least one surface of a compound comprising (a) a metal of the group comprising nickel, copper, iron and cobalt, and (b) another element of the group comprising any of the preceding metals, titanium, lanthanides, magnesium, boron, molybdenum, manganese, vanadium, niobium and tantalum and their hydrogenation products. The cathode is particularly useful in the electrolysis of alkali chlorides.

29 Claims, No Drawings

CATHODE FOR ELECTROLYTIC CELL

BACKGROUND OF THE INVENTION

The invention relates to a new cathode for a cell for electrolysis, particularly of alkali chlorides, adapted to reduce overvoltage on contact with electrolyte.

In electrolysis, e.g., of alkali chlorides in an aqueous medium, it is known that, when the cathode is made of metals widely employed in industry, the potential which has to be applied to the cathode is higher in absolute value than that corresponding to the thermodynamic potential for the formation (and release) of molecular hydrogen. This difference between the potential applied and the thermodynamic potential (overvoltage) causes additional energy consumption and must, therefore, be minimized. In industrial installations allowance must further be made for the cost of the means employed and for the various economic or technical requirements in general. In the cells with solid cathodes, usually based on iron, which are used in industry particularly for electrolyzing sodium chloride, overvoltages of −200 to −300 mv. are commonly reached under industrial working conditions.

A great deal of research is knonw to have been done on electrode coatings and particularly anode coatings to reduce overvoltage, and the results of the research have been published. These include French Pat. No. 1,506,040 which describes anodes of bronze made from tungsten, titanium and various other metals. These electrodes are intended specifically for use as anodes and their chemical behavior in an alkaline medium makes them unsuitable for use in industrial electrolysis of alkali chlorides.

The present invention has now made it possible to achieve a marked reduction in cathodic overvoltage to a low value, which is relatively stable with time, without involving additional expense which would be prohibitive to the manufacturer and user.

Accordingly, it is an object of the present invention to provide a novel cathode for an electrolysis cell which will provide a reduced overvoltage when in contact with the electrolyte.

It is another object of the present invention to provide a novel cathode free from a number of disadvantages of the prior art.

Other objects will be apparent to those skilled in the art from the present description.

GENERAL DESCRIPTION OF THE INVENTION

The subject matter of the invention is a cathode for a cell for electrolysis in an alkaline medium, characterized in that it comprises at least one surface made of a compound comprising (a) a metal of the group comprising nickel, copper, cobalt and iron, and (b) another element of the group comprising any of the preceding metals of group (a), titanium, molybdenum, tungsten, lanthanides, magnesium, manganese, vanadium, niobium, tantalum and boron, or their hydrogenation products.

Electrolytic processes in which the cathode of the invention may be applied particularly comprise electrolysis of alkali chlorides for the preparation of chlorine and alkaline base, hypochlorite, chlorate or perchlorate, electrolysis of bases themselves or aqueous alkaline solutions in general, and various electro-chemical processes carried out in an alkaline medium, during which hydrogen is released, provided that a high overvoltage is not necessary to produce a reducing reaction, for example, at the cathode. Furthermore, the cathode of the invention may be used in many different types of cell, e.g., with a diaphragm or membrane or without separation, etc., in the form of a uni-polar or multi-polar electrode.

The word "compound" used above refers either to a substance of defined formulation or to a polyphase material comprising a pair of the above-mentioned metals.

In an alternative embodiment of the invention, the cathode for a cell for electrolysis in an alkaline medium has at least one surface consisting of a binary compound of (a) a metal of the group comprising nickel, copper and cobalt, and (b) another element of the group comprising any of the previous metals of group (a), titanium, lanthanides, magnesium, and boron, or their hydrogenation products.

A preferred category of these binary compounds comprises alloys or compositions of titanium and nickel and particularly combinations of these two metals in which the proportion of nickel atoms is from 15 to 85%, and more particularly from 15 to 40% and from 55 to 75%, owing to the remarkable effect on overvoltage obtained between these last limits and owing to the good mechanical behavior of the materials obtained.

The proportion of atoms of the element from the second group (b) may vary substantially from one compound to another; for example, in cases where the element is titanium, the atomic porportion may be from 15 to 85%; for magnesium it may advantageously be from 2 to 5% and in the case of boron it is preferably from 15 to 85%.

In a second alternative embodiment of the invention, the cathode for an electrolytic cell has at least one of its faces made of a composition formed by a non-stoichiometric compound comprising a metal B taken from the group comprising titanium, tungsten, molybdenum, manganese, cobalt, vanadium, niobium and tantalum, bonded by a metal M from the group comprising nickel, cobalt, iron and copper; the non-stoichiometric compound further comprises oxygen and an additional inserted metal of the group comprising alkali metals and lanthanides and having the general formula Ax By Oz wherein By Oz represents the highest valency oxide of the metal B and x is a number from 0 to 1.

It should be understood that By Oz represents the formula for the oxide in which y and z are the smallest integers in which the atomic ratio between B and O can be expressed; thus, By Oz may represent $TiO_2$ or $V_2O_5$ but not $Ti_2O_4$ or $V_4O_{10}$.

The compounds of formula Ax By Oz are generally described as "bronze" by insertion. They may be of a structure which is amorphous and thus incapable of examination with X-rays. However, it is possible in that case to make them re-crystallize after heating in an inert atmosphere. These polyphase materials may be more complex than is indicated by the formula and may contain a small proportion by weight of other elements such as hydrogen, inserted in the By Oz lattice. It should also be noted that the element B has an apparent degree of oxidation which does not correspond to its maximum value (see on this subject Rao "Solid State Chemistry", p. 32, Ed. Dekker 1974).

The preferred compounds of formula Ax By Oz are those in which B represents titanium and A sodium. They lower the overvoltage very appreciably and have excellent chemical behavior.

In the composition which forms the active cathode surface and comprises titanium and nickel, the proportions of the various constituents come within the following limits:

Na : 2–10 parts by weight
Ti : 7–20 parts by weight
O : 15–30 parts by weight
Ni : 40–400 parts by weight The Ti/Na ratio is preferably from 2 to 2.5/1 (by weight).

When other elements are substituted for those above, the ratio is of the same order, allowance being made for the atomic weights of the elements.

In a few special cases the use of bronze without a binder may be envisaged. The cost is then higher and no one has so far succeeded in preparing cathodes of that compound which have satisfactory properties during electrolysis in an alkaline medium.

The compositions defined above are adapted for use in solid form to form the electrode.

As a means of further improving mechanical properties and reducing costs, it has been found particularly advantageous to use cathodes comprising a deposit of a compound of the above elements on a carrier such as iron, steel or nickel. It is preferable to use iron or steel since the composite electrode obtained than has remarkable properties both from the electrochemical and the mechanical point of view. A carrier consisting of a grid or of expanded metal has advantages for the release of hydrogen. The thickness of the cathodes according to the invention is not the determining factor. In cases where the binary compound is used without a carrier, a thickness of 0.5 to 5 mm. will generally give adequate mechanical properties. In cases where the compound is deposited on a carrier, a good covering for one surface of the carrier is sufficient, i.e., a thickness of 0.1 to 3 mm. The upper limit to the thickness is obviously not essential, but for economic and other reasons, there is no advantage to form thick layers.

The electrodes are prepared by various known processes, particularly by fusing or calcining the constituents of the product according to the invention in the selected proportions, while screening them from oxygen, nitrogen and water in particular, e.g., in an inert atmosphere such as of hydrogen or a rare gas. In the case of calcining, pressures of 1 to $2.10^8$ Pascals at 20° C. are exerted generally before heating to temperatures of 400° to 1000° C.

When the compound is deposited on a carrier, various methods may be used, particularly projection by plasma, cathode sputtering, metallization under vacuum, coating or depositing a mixture of previously pulverized compounds by explosion, etc. The mixture of constituents may also be deposited by electrolysis or decomposition of salts of the elements, possibly followed by heat treatment in a neutral or reducing atmosphere. Heat treatment has the advantage of diffusing the coating into the carrier or substrate and thus improving the cohesion of the whole component. A temperature of 600° to 1000° C. is appropriate. The carrier or substrate is understood as being a metal, such as iron, or equally an underlying layer obtained by fusing or calcining the binary compound. An intermediate bonding layer may also be deposited between the carrier and its coating, provided that the layer does not cause a marked drop in the conductivity of the whole component. Finally, in the case of a multi-polar electrode, the compound may be applied to an appropriate anodic material, e.g., titanium, possibly with an intermediate bonding layer interposed. Data on electrolytic methods of deposing such binary mixtures is contained in an article by PERVYI and PRESNOV (UKR.XHYM.-ZNO USSR 1973.39 (G) p. 553–555).

The electrode can be bonded to the conductor supplying the current without any dificulty, e.g., by a mechanical means, by welding or by bedding the conductor in the active compound when it is formed.

When the second alternative embodiment of the invention is used, the preferred method of preparing the electrodes is by electrolytic deposition. This will be explained in greater detail in the examples. The composition of the deposit may be controlled by various means, e.g., by adjusting the concentration of the various constituents of the electrolytic bath, the pH of the bath or the temperature at which depositing takes place. The pH may be set at a value close to neutral (generally from 5 to 7) by adding a base, although it is also possible and often advantageous to allow the pH value to be increased by the formation of hydroxyl ions. The composition of the deposit may then vary continuously, and the active layer of almost pure metal on its external surface has an increasing content of "bronze" from that surface to the underlying layer on which the active layer is deposited.

Another process which may be employed comprises forming an intimate mixture of oxide of transition metal and of a decomposable alkaline salt into pellets at a pressure of over $10^8$ Pascas. The pellets are heated in a platinum crucible, e.g., to about 1300° C. The product obtained is cooled, then ground and reduced hot in a hydrogen atmosphere. After cooling, it is purified by dissolving the impurities. The purified product is mixed with powdered metal binder and the mixture is compressed at about $10^8$ Pascals to shape it as an electrode.

The active electrode surfaces consisting of bronze and binding metal show remarkable properties when the electrode is used as cathode in an alkaline medium, particularly when electrolyzing alkali chlorides, for binding metal/bronze weight ratios of over 1/1. There is no substantial adverse change in these properties until ratios of approximately 10/1 are reached. This considerably reduces the cost of the electrodes. Their satisfactory mechanical properties in the solid state may be further improved by depositing the bronze and binding metal composition on a metal carrier.

The important advantage of the cathodes according to the invention is illustrated particularly by measuring their potential relative to a saturated calomel electrode (SCE). The electrolyte contains 140 g/liter of caustic soda and 160 g/ liter of sodium chloride. Linearly variable voltages are applied to the cathode with a speed of advance of 100 mV/min. The temperature is 90° C. The overvoltages in millivolts SCE are as follows (Table 1below), for different compositions of the binary compound of nickel and titanium:

TABLE 1

| % atoms Ni / Current Densities | 20 | 30 | 40 | 50 | 60 | 70 | 80 |
|---|---|---|---|---|---|---|---|
| 20 A/dm.$^2$ | −100mV | weak | weak | −150mV | − 60mV | −125mV | −225mV |
| 40 A/dm.$^2$ | −180mV | −125mV | −130mV | −225mV | −120mV | −200mV | −320mV |

The thermodynamic potential, measured under the same conditions with a (reversible) platinised platinum cathode, is known to be −1075 mV (SCE) and that of a conventional iron cathode −1390 to −1430 mV, corresponding to overvoltages of −315 to −355 mV.

Overvoltages at 20 A/dm.$^2$ for proportions of 20 to 40% nickel atoms are difficult to assess in the above measuring method, firstly, because of their low value and secondly, because of the accompanying effects (sorption of hydrogen) when equilibrium has not been reached. Nevertheless, one can deduce that there are two minima in the absolute value of the overvoltage, observed when the proportions of nickel atoms are 33.3% ($Ti_2Ni$) and 55%, approximately.

The development of the overvoltages is checked by measuring the potentials during long-term tests, equilibrium being reached at the time when the measurements are taken. The electrolyte contains 140 g/liter of caustic soda and 160 g/liter of sodium chloride, the temperature is 90° C., and the current density 20 A/dm.$^2$.* See Table II, below.

* As used throughout, A/dm.$^2$ refers to amperes per square decimeter.

TABLE 2

| Compound of Ni and Ti % atoms of Ni | 24.5 | 33.3 | 61.5 | 65 | Iron |
|---|---|---|---|---|---|
| Duration of test at time of measurement | 2350 h | 3200 h | 1900 h | 1750 h | 2800 h |
| Voltage mV/SCE | −1170 | −1170 | −1140 | −1170 | −1430 |

Like the previous experiments, the results of which have been given in the description, these tests are carried out with solid cathodes (Ti-Ni) without a carrier or support. It will be noted that there is no result for contents between 33.3 and 61.5% of nickel atoms. This is because electrodes of this type with a nickel content of 40 to 55% are breakable, which justifies the mention of the two preferred ranges in the content of these compounds.

SPECIFIC DESCRIPTION OF THE INVENTION

In order to disclose more clearly the nature of the present invention, the following examples illustrating the invention are given. It should be understood, however, that this is done solely by way of example and is intended neither to delineate the scope of the invention nor limit the ambit of the appended claims. In the examples which follow, and throughout the specification, the quantities of material are expressed in terms of parts by weight, unless otherwise specified.

The examples given below use cathodes according to the invention, solid ones in Examples 1, 5, 6, 7 and 12 and in the preferred form, i.e., on a metal carrier or substrate, in the other examples. The method of preparation is explained. The electrolyte composition and current density are chosen so that they come close to industrial conditions and provide comparative values within the scope of the expert. Thus, it is obvious that such examples cannot limit the field of the invention.

EXAMPLE 1

A homogenized mixture of 4.79 g. (grams) of powdered titanium and 2.98 g. of powdered nickel are heated in argon for 1 hour at 850° C. in a flat-based refractory vessel. When the product has cooled, it is a solid plate of metallic appearance. A slab 1 × 1 cm. in section is cut out of the plate and used as a cathode in electrolysis at 90° C. of an aqueous solution containing 140 g/liter NaOH and 160 g/liter NaCl. For current densities of 20 A/dm.$^2$, 40 A/dm.$^2$, and 100 A/dm.$^2$, the cathode voltages noted relative to the saturated calomel electrode are −1080 mV, −1110 mV and 1150 mV, respectively; the speed of advance of the potential applied being 100 mV/min. If electrolysis is continued under the same conditions (current density 20 A/dm.$^2$) the voltage increases then stabilizes after 20 hours at −1180 mV SCE. This probably corresponds to stabilized hydrogenation of the cathode. The cathode remains mechanically stable.

EXAMPLE 2

A homogenized mixture of powdered titanium and powdered nickel in a weight ratio of 95.80/58.70, corresponding to the compound $Ti_2Ni$, is heated in argon at 920° C. for 24 hours. The product is crushed to a grain size of about 40 microns and pulverized on a wire netting 2.5 mm. in diameter with 4 × 4 mm. meshes, with a plasma blow pipe. The vector gas is argon. A graph of the curves of cathode potential is an electrolyte similar in composition to that of Example 1 and under the same conditions as in Example 1 gives the following results for various current densities (Table 3);

TABLE 3

| Current Density (A/dm.$^2$) | Potential (SCE) in mV |
|---|---|
| 20 | −1140 |
| 40 | −1250 |
| 60 | −1300 |
| 80 | −1330 |

At a current density of 20 A/dm.$^2$, the voltage rapidly stabilizes at −1170 mV (SCE).

EXAMPLE 3

A compound of titanium and nickel is deposited electrolytically on a previously sanded iron plate at 60° C. from an electrolyte of the following composition:

| | |
|---|---|
| $Ti_2(SO_4)_3$ | 93.3 g. |
| $NiSO_4, 7H_2O$ | 41 g. |
| $(NH_4)_2SO_4$ | 8 g. |
| $Na_2HPO_4$ | 6.25 g. |
| Na F | 16 g. |
| Sodium citrate | 19 g. |
| Glucose | 9 g. |
| Water | to make up to 500 ml. |
| The pH is approximately | 2.5 |

The electrode thus obtained is used as a cathode in a bath and under conditions identical with those in the previous examples. The potentials measured (SCE) are:

| |
|---|
| −1200 mV with current densities of 20 A/dm.$^2$ |
| −1210 mV with current densities of 40 A/dm.$^2$ |
| −1230 mV with current densities of 80 A/dm.$^2$ |

It will be noted that depositing the binary compound on metal substrate or carrier does not produce appreciably higher overvoltage than that produced when the compound alone is used.

EXAMPLE 4

A compound of nickel and magnesium is deposited by electrolysis on a previously sanded iron plate at room temperature, from an electrolyte of the following composition:

| | |
|---|---|
| $NiCl_2$, 6 $H_2O$ | 25 g/liter |
| $MgCl_2$, 6 $H_2O$ | 200 g/liter |
| $C_6H_8O_7$, $H_2O$ (citric acid) | 21 g/liter |
| $NH_4Cl$ | 5 g/liter |
| $C_6H_{12}O_6$ (glucose) | 8 g/liter |

The pH is adjusted to 5.5 with ammonia. The binary compound deposited (15 mg./cm.$^2$) contains 2.4% of magnesium atoms.

The electrode thus obtained is used as the cathode in a bath and under conditions identical with those in the previous examples. The potentials measured (SCE) are:

| |
|---|
| −1190 mV with current densities of 20 A/dm.$^2$ |
| −1210 mV with current densities of 40 A/dm.$^2$ |
| −1230 mV with current densities of 80 A/dm.$^2$ |

EXAMPLE 5

A homogenized mixture of powdered boron and powdered nickel in a weight ratio of 4.8 g./25.3 g., corresponding to the compound NiB, is heated in argon at 765° C. for 6 hours, 30 minutes. When the product has been cooled in argon, it is a solid plate of metallic appearance. A slab 1 × 1 cm. in section is cut out of the plate and used as cathode in electrolysis at 90° C. of an aqueous solution containing 140 $gl^{-1}$ NaOH and 160 $gl^{-1}$ NaCl. For current densities of 20 A/dm.$^2$, 40 A/dm.$^2$, and 80 A/dm.$^2$, the cathode voltages noted relative to the saturated calomel electrode are −1180 mV, −1230 mV and −1280 Mv, respectively; the speed at which the potential applied advances is 100 mV/min.

EXAMPLE 6

A homogenized mixture of powdered boron (10 g.) and powdered nickel (20 g.), corresponding to 73% of boron atoms, is heated in argon at 900° C. for 4 hours, 30 minutes. When the product has been cooled in argon it is a solid plate of a metallic appearance. A slab 1 × 1 cm. in section is cut out of the plate and used as cathode in electrolysis at 90° C. of an aqueous solution containing 140 $gl^{-1}$ NaOH and 160 $gl^{-1}$ NaCl. For current densities of 20 A/dm.$^2$, 40 A/dm.$^2$ and 80 A/dm.$^2$, the cathode voltages noted relative to the saturated calomel electrode are −1170 mV, −1210 mV and −1260 mV, respectively; the speed of advance of the potential applied is 100 mV/min.

EXAMPLE 7

A homogenized mixture of powdered boron (3.67 g.) and powdered iron (37.25 g.), corresponding to $Fe_2B$, is heated in argon at 1050° C., for 6 hours, 30 minutes. When the product has cooled in argon, it is a solid plate of metallic appearance. A slab 1 × 1 cm. in section is cut out of the plate and used as cathode in electrolysis at 90° C. of an aqueous solution containing 140 $gl^{-1}$ NaOH and 160 $gl^{-1}$ NaCl. For a current density of 20 A/dm.$^2$, the cathode voltage noted is −1340 mV relative to the saturated calomel electrode. The speed of advance of the potential applied is 100 mV/min.

EXAMPLE 8

A mixture of titanium-sodium bronze and nickel is deposited by electrolysis on a previously sanded and degreased iron plate measuring 8 cm.$^2$, from an electrolyte of the following composition:

| |
|---|
| 65 g/liter of titanium III chloride solution (solution containing 15% by weight of $TiCl_3$) |
| 25 g/liter of sodium fluoride - NaF. |
| 36 g/liter of trisodium citrate - $Na_3C_6H_5O_7 . 5.5 H_2O$. |
| 5.4 g/liter of ammonium chloride - $NH_4Cl$. |
| 24 g/liter of nickel chloride - $NiCl_2 . 6 H_2O$. |

The pH of the electrolyte is carefully adjusted to 5.5 with caustic soda at the beginning.

Electrolysis is carried out at room temperature (25° C.) in a cell with compartments separated by a diaphragm, at a current density of 5 A/dm.$^2$; the cathode compartment has a volume of 300 cc. In 1 hour of electrolysis, the pH reaches 9.2 and an average deposit of 20 mg./cm.$^2$ is obtained. The percentage by weight of the chief constituents of this deposit, determined by conventional chemical analytical methods for the cations and by neutron activation for the oxygen, is:

| | |
|---|---|
| Ti | 11% |
| Ni | 55% |
| Na | 5% |
| O | 23% |

The electrode thus obtained is used as cathode in a bath at 90° C. containing 140 g/liter of caustic soda and 160 g/liter of sodium chloride. The potentials measured relative to a reference calomel-saturated potassium chloride electrode (SCE) are:

| |
|---|
| −1160 mV with a current density of 20 A/dm.$^2$ |
| −1180 mV with a current density of 40 A/dm.$^2$ |
| −1200 mV with a current density of 80 A/dm.$^2$ |

EXAMPLE 9

A mixture of titanium-sodium bronze and cobalt is deposited by electrolysis on a previously sanded and degreased iron plate of the same size as in the previous example, from an electrolyte of the following composition:

| |
|---|
| 65 g/liter of titanium III chloride solution (solution containing 15% by weight of $TiCl_3$) |
| 25 g/liter of sodium fluoride - NaF. |
| 36 g/liter of trisodium citrate - $Na_3C_6H_5O_7 . 5.5 H_2O$. |
| 5.4 g/liter of ammonium chloride - $NH_4Cl$. |

-continued

| |
|---|
| 36 g/liter of cobalt chloride - $CoCl_2 . 6 H_2O$. |

The pH of the electrolyte is adjusted to about 5.5 with caustic soda at the beginning, and electrolysis is carried out under the same conditions as in Example 1, the final pH is 6.9.

The deposit contains 6.2% of Ti and 75.5% of cobalt (by weight).

The electrode thus obtained is used as cathode in a bath and with conditions identical to those in Example 1. The potentials measured (SCE) are:

| |
|---|
| −1180 mV with a current density of 20 A/dm.$^2$ |
| −1200 mV with a current density of 40 A/dm.$^2$ |
| −1220 mV with a current density of 80 A/dm.$^2$ |

EXAMPLE 10

A mixture of titanium-sodium bronze and iron is deposited by electrolysis, on an iron plate measuring 8 cm.$^2$ under conditions identical to those in the previous examples from an electrolyte of the following composition:

| |
|---|
| 65 g/liter of aqueous solution of titanium III chloride (containing 15% by weight of $TiCl_3$) |
| 25 g/liter of sodium fluoride - NaF. |
| 36 g/liter of trisodium citrate - $Na_3C_6H_5O_7 . 5.5 H_2O$. |
| 5.4 g/liter of ammonium chloride - $NH_4Cl$. |
| 42 g/liter of ferrous sulphate - $FeSO_4 . 7 H_2O$. |

The composite electrode obtained is used as cathode in a bath and under conditions identical to those in Example 1. The potentials measured (SCE) are:

| |
|---|
| −1190 mV with a current density of 20 A/dm.$^2$ |
| −1210 mV with a current density of 40 A/dm.$^2$ |
| −1240 mV with a current density of 80 A/dm.$^2$ |

EXAMPLE 11

A mixture of titanium-potassium bronze and nickel is deposited by electrolysis on an iron carrier or support under conditions identical with those in the previous examples, from an electrolyte of the following composition:

| |
|---|
| 65 g/liter of titanium III chloride (solution containing 15% by weight of $TiCl_3$) |
| 35 g/liter of potassium fluoride - KF. |
| 21 g/liter of citric acid - $C_6H_8O_7 . H_2O$. |
| 5.4 g/liter of ammonium chloride. |
| 24 g/liter of nickel chloride - $NiCl_2 . 6 H_2O$. |

The pH is adjusted to 5.5 with potassium hydroxide.

The electrode obtained is used as cathode in a bath and under conditions identical with those in Example 1. The potentials measured (SCE) are:

| |
|---|
| −1220 mV with a current density of 20 A/dm.$^2$ |
| −1240 mV with a current density of 40 A/dm.$^2$ |
| −1270 mV with a current density of 80 A/dm.$^2$ |

EXAMPLE 12

21.2 g. of $Na_2CO_3$ and 47.94 g. of $TiO_2$ are weighed out. When they have been ground and the powders intimately mixed, the mixture is put into pellet form at a pressure of approximately $2.10^8$ Pascals. The pellets thus obtained are heated in air in a platinum crucible. The temperature is kept constant for one hour every 100° C. from 600° to 900° C., then kept at 1300° C. for 20 hours.

The ground mixture undergoes partial reduction for 48 hours at 1000° C. in a hydrogen-argon (15–85) atmosphere in a platinum crucible. When the product has been ground, it is purified by treatment with $H_2SO_4$ (1N) + HF (1N) at 90° C. lasting 1 hour. The final product is identified by X-ray examination. It is composed of $Na_x Ti_8 O_{16}$; $x$ is approximately 1.6.

The ground $Na_x Ti_8 O_{16}$ product is mixed with powdered nickel (approximately 50–50 by volume) and the mixture is put into pellet form at a pressure of about $10^8$ Pascals.

Electrolysis is carried out as before in an aqueous medium containing NaOH 140 g/liter - NaCl 160 g/liter.

The following cathode voltages are noted:

| |
|---|
| −1175 mV SCE for a current density of 20 A/dm.$^2$ |
| −1175 mV SCE for a current density of 40 A/dm.$^2$ |
| −1225 mV SCE for a current density of 80 A/dm.$^2$ |

As will be apparent to those skilled in the art, the foregoing examples can be repeated using other pairings of metals in accordance with the present invention.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed.

What is claimed is:

1. An electrolytic cell cathode for electrolysis of an alkaline medium, said cathode comprising at least one surface of a binary mixture of (a) a metal of the group consisting of nickel, cobalt, and copper, and (b) another element of the group consisting of any preceding metal or group (a), titanium, lanthanides, and magnesium, or their hydrogenation products.

2. A cathode according to claim 1, wherein the binary mixture is made up essentially of titanium and nickel.

3. A cathode according to claim 2, wherein the proportion of nickel atoms in the binary mixture is from 15 to 85%.

4. A cathode according to claim 3, wherein the proportion of nickel atoms in the binary mixture is from 15 to 40%.

5. A cathode according to claim 4, wherein the proportion of nickel atoms in the binary mixture is from 55 to 75%.

6. A cathode according to claim 1, wherein the said cathode is a uniform solid and free of support.

7. A cathode according to claim 1, wherein said surface of said cathode is applied to a metal support.

8. An electrolytic cell cathode for electrolysis of an alkaline medium, said cathode comprising at least one surface of a composition formed by a non-stoichiometric compound consisting of a metal B of the group consisting of titanium, tungsten, molybdenum, manganese, cobalt, vanadium, niobium and tantalum, bonded by a metal M of the group consisting of nickel, cobalt, iron and copper, said non-stoichiometric compound further comprising a bronze of composition of the formula $A_x$ $B_y O_z$ in which O stands for oxygen, A is an inserted metal of the group consisting of alkali metals and lanthanides, B is a metal as above identified, wherein $B_y O_z$ represents the highest valency oxide of metal B, and $x$ is a number between 0 and 1.

9. A cathode according to claim 8, wherein the metal A of said non-stoichiometric compound is sodium and the metal B of that compound is titanium.

10. A cathode according to claim 9, wherein the weight ratio of Ti to Na is from 2 to 2.5:1.

11. A cathode according to claim 8, wherein the weight ratio of the metal M to the non-stoichiometric compound is from 1 to 10:1.

12. A cathode according to claim 8, wherein the said cathode is a uniform solid and free of support.

13. A cathode according to claim 8, wherein said surface of said cathode is applied to a metal support.

14. A cathode according to claim 13, wherein the metal support is a metal of the group consisting of nickel, iron and steel.

15. A cathode according to claim 7, wherein the composition which makes up at least one active surface of said cathode has a ratio of bonding metal to non-stoichiometric compound which varies continuously from one side to the other.

16. An electrolytic cell for the electrolysis of an alkaline medium having a cathode comprising at least one surface of a binary mixture of (a) a metal of the group consisting of nickel, cobalt, and copper, and (b) another element of the group consisting of any preceding metal of group (a), titanium, lanthanides, and magnesium, or their hydrogenation products.

17. An electrolytic cell according to claim 16, wherein the binary mixture is made up essentially of titanium and nickel.

18. An electrolytic cell according to claim 17, wherein the proportion of nickel atoms in the binary mixture is from 15 to 85%.

19. An electrolytic cell according to claim 17, wherein the proportion of nickel atoms in the binary mixture is from 15 to 40%.

20. An electrolytic cell according to claim 17, wherein the proportion of nickel atoms in the binary mixture is from 55 to 75%.

21. An electrolytic cell according to claim 16, wherein the said cathode is a uniform solid and free of support.

22. An electrolytic cell according to claim 16, wherein said surface of said cathode is applied to a metal support.

23. A process for the electrolysis of an alkali-metal chloride in an aqueous alkaline medium, employing an electrolytic cell equipped with a cathode, said cathode comprising at least one surface of a binary mixture of (a) a metal of the group consisting of nickel, cobalt, and copper, and (b) another element of the group consisting of any preceding metal of group (a), titanium, lanthanides, and magnesium, or their hydrogenation products.

24. A process for electrolysis according to claim 23, wherein the binary mixture is made up essentially of titanium and nickel.

25. A process for electrolysis according to claim 24, wherein the proportion of nickel atoms in the binary mixture is from 15 to 85%.

26. A process for electrolysis according to claim 24, wherein the proportion of nickel atoms in the binary mixture is from 15 to 40%.

27. A process for electrolysis according to claim 24, wherein the proportion of nickel atoms in the binary mixture is from 55 to 75%.

28. A process for electrolysis according to claim 23, wherein the said cathode is a uniform solid and free of support.

29. A process for electrolysis according to claim 23, wherein said surface of said cathode is applied to a metal support.

* * * * *

UNITED STATES PATENT AND TRADEMARK OFFICE

CERTIFICATE OF CORRECTION

PATENT NO. : 4,080,278

DATED : March 21, 1978

INVENTOR(S) : Dominique Ravier et al.

It is certified that error appears in the above-identified patent and that said Letters Patent are hereby corrected as shown below:

Col. 1, line 25, delete "knonw" and replace with -- known --.

Col. 4, line 13, delete "dificulty" and replace with -- difficulty --.

Col. 4, line 38, delete "Pascas" and replace with -- Pascals --.

Col. 8, lines 10 and 11, delete 140 $gl^{-I}NaOH$ and 160 $gl^{-I}NaCl$" and replace with -- 140 $gl^{-I}NaOH$ and 160 $gl^{-I}NaCl$ --.

Signed and Sealed this

*Thirtieth* Day of *January 1979*

[SEAL]

*Attest:*

RUTH C. MASON
*Attesting Officer*

DONALD W. BANNER
*Commissioner of Patents and Trademarks*